United States Patent [19]

Michalski

[11] Patent Number: 4,713,617

[45] Date of Patent: Dec. 15, 1987

[54] DIGITAL TIMING LIGHT

[75] Inventor: Steven E. Michalski, Milwaukee, Wis.

[73] Assignee: Snap-on Tools Corporation, Kenosha, Wis.

[21] Appl. No.: 857,359

[22] Filed: Apr. 30, 1986

[51] Int. Cl.[4] ..... F02P 17/00

[52] U.S. Cl. ..... 324/395; 73/499; 324/392; 324/402

[58] Field of Search ..... 324/391, 392, 395, 402; 73/499

[56] References Cited

U.S. PATENT DOCUMENTS

| | | | |
|---|---|---|---|
| 3,364,418 | 1/1968 | MacCrea | 324/392 |
| 3,955,135 | 5/1976 | Fastaia . | |
| 4,095,170 | 6/1978 | Schmitt . | |
| 4,117,395 | 9/1978 | Redfield | 324/391 |
| 4,125,894 | 11/1978 | Cashel et al. . | |
| 4,128,005 | 12/1978 | Arnston et al. . | |
| 4,454,475 | 6/1984 | Tsuchiya | 324/392 |
| 4,469,952 | 9/1984 | Olson et al. | 324/392 X |
| 4,472,779 | 9/1984 | Marino et al. . | |

*Primary Examiner*—Reinhard J. Eisenzopf
*Assistant Examiner*—Robert W. Mueller
*Attorney, Agent, or Firm*—Emrich & Dithmar

[57] ABSTRACT

Engine timing apparatus includes a timing light and a pickup for producing a pickup signal in response to each ignition in a selected cylinder. The operator keys in the desired advance or retard angle in degrees in a range anywhere between +180° and −180°. A program-controlled microcontroller with an internaltimer samples the time period between pickup signals and, using this information and the advance of retard angle, calculates engine rpm and the proper time delay for the flash. The system automatically corrects for system delays to produce extremely accurate timing functions. The system may be used with an inductive pickup for timing gasoline engines or with a luminosity pickup for timing diesel engines. At high rpms the system produces a flash in response to every other pickup signal.

18 Claims, 14 Drawing Figures

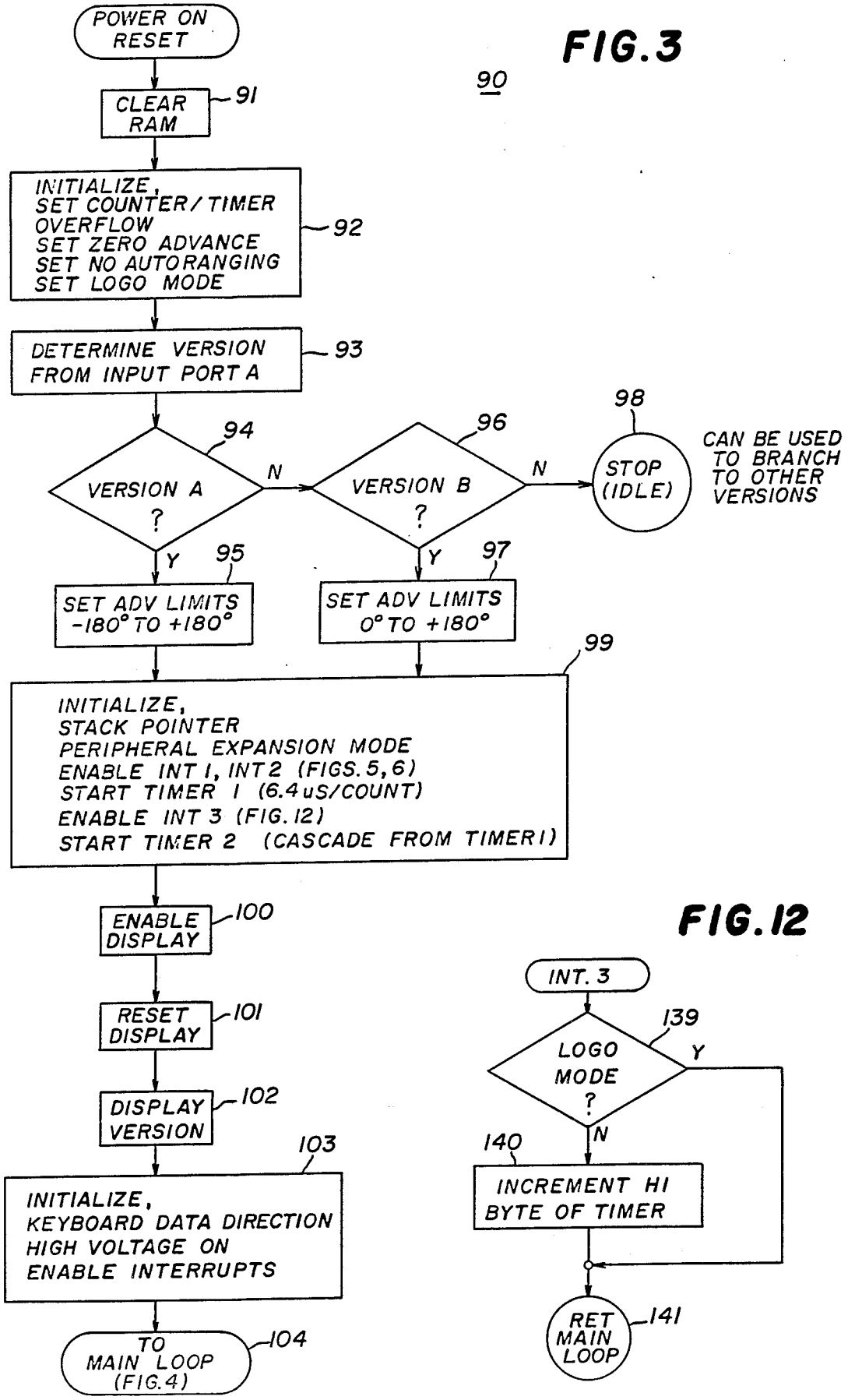
FIG. 3
90
POWER ON RESET
CLEAR RAM
91
INITIALIZE, SET COUNTER/TIMER OVERFLOW SET ZERO ADVANCE SET NO AUTORANGING SET LOGO MODE
92
DETERMINE VERSION FROM INPUT PORT A
93
VERSION A ?
94
N
VERSION B ?
96
N
STOP (IDLE)
98
CAN BE USED TO BRANCH TO OTHER VERSIONS
Y
95
SET ADV LIMITS -180° TO +180°
Y
97
SET ADV LIMITS 0° TO +180°
99
INITIALIZE, STACK POINTER PERIPHERAL EXPANSION MODE ENABLE INT 1, INT 2 (FIGS. 5, 6) START TIMER 1 (6.4 uS/COUNT) ENABLE INT 3 (FIG. 12) START TIMER 2 (CASCADE FROM TIMER 1)
ENABLE DISPLAY
100
RESET DISPLAY
101
DISPLAY VERSION
102
103
INITIALIZE, KEYBOARD DATA DIRECTION HIGH VOLTAGE ON ENABLE INTERRUPTS
TO MAIN LOOP (FIG. 4)
104
FIG. 12
INT. 3
LOGO MODE ?
139
Y
N
140
INCREMENT HI BYTE OF TIMER
RET MAIN LOOP
141

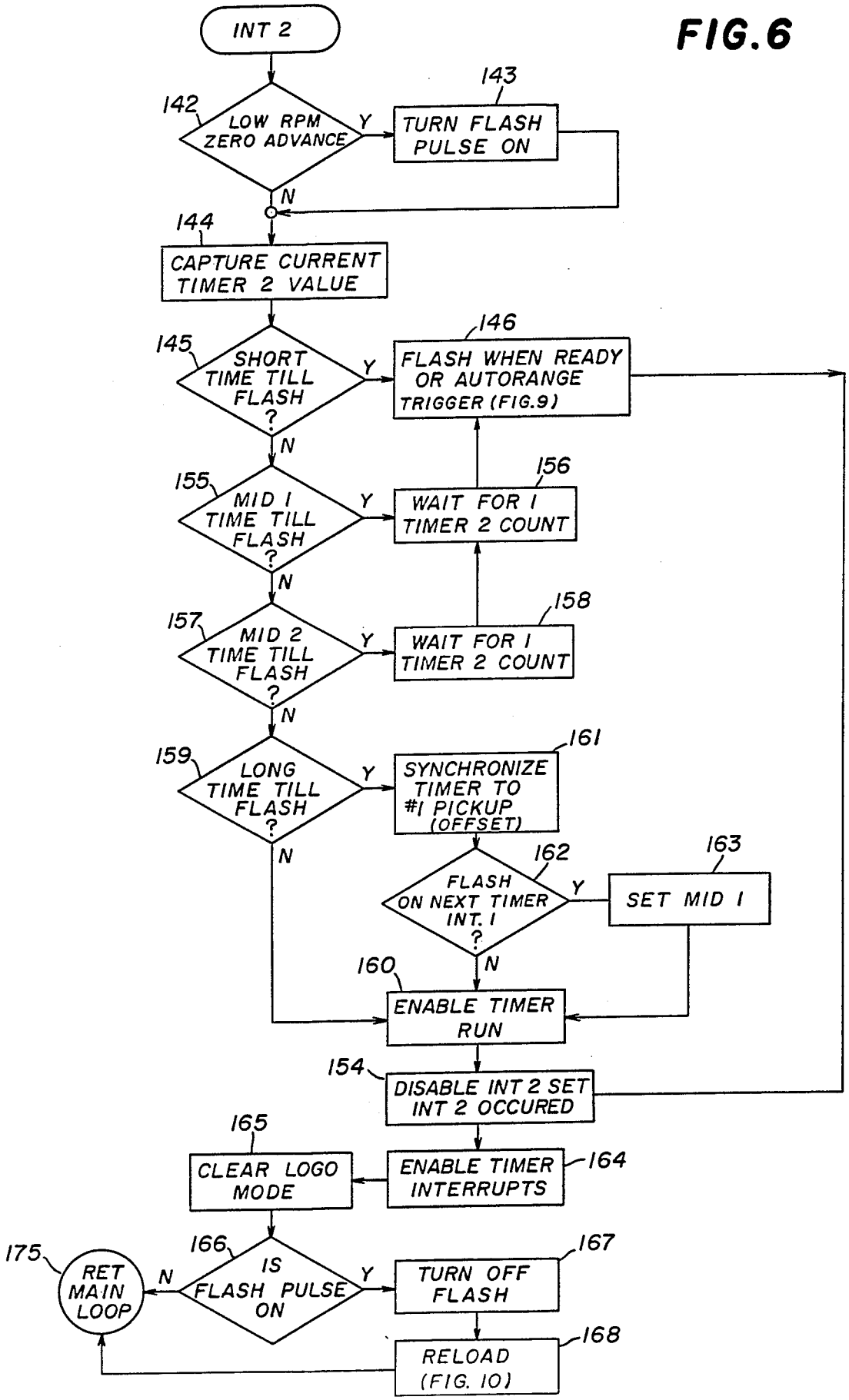
FIG. 6
INT 2
142
LOW RPM ZERO ADVANCE
Y
N
143
TURN FLASH PULSE ON
144
CAPTURE CURRENT TIMER 2 VALUE
145
SHORT TIME TILL FLASH ?
146
FLASH WHEN READY OR AUTORANGE TRIGGER (FIG.9)
155
MID 1 TIME TILL FLASH ?
156
WAIT FOR 1 TIMER 2 COUNT
157
MID 2 TIME TILL FLASH ?
158
WAIT FOR 1 TIMER 2 COUNT
159
LONG TIME TILL FLASH ?
161
SYNCHRONIZE TIMER TO #1 PICKUP (OFFSET)
162
FLASH ON NEXT TIMER INT. 1 ?
163
SET MID 1
160
ENABLE TIMER RUN
154
DISABLE INT 2 SET INT 2 OCCURED
165
CLEAR LOGO MODE
ENABLE TIMER INTERRUPTS
164
175
RET MAIN LOOP
166
IS FLASH PULSE ON
167
TURN OFF FLASH
168
RELOAD (FIG. 10)

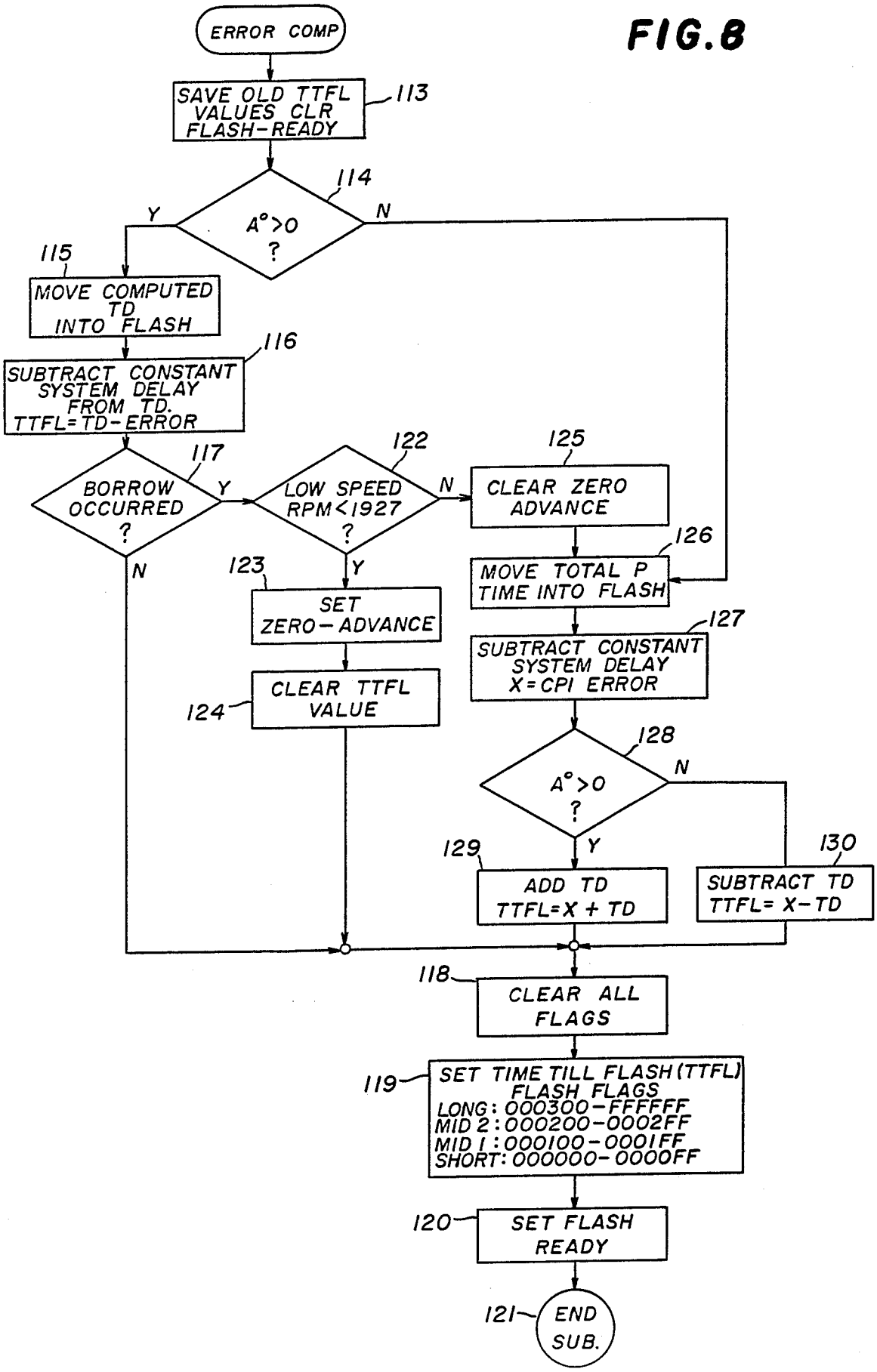
FIG. 8
ERROR COMP
SAVE OLD TTFL VALUES CLR FLASH-READY
113
114
A° > 0 ?
Y
N
115
MOVE COMPUTED TD INTO FLASH
116
SUBTRACT CONSTANT SYSTEM DELAY FROM TD. TTFL=TD-ERROR
117
BORROW OCCURRED ?
Y
N
122
LOW SPEED RPM<1927 ?
N
Y
123
SET ZERO-ADVANCE
124
CLEAR TTFL VALUE
125
CLEAR ZERO ADVANCE
126
MOVE TOTAL P TIME INTO FLASH
127
SUBTRACT CONSTANT SYSTEM DELAY X=CPI ERROR
128
A° > 0 ?
N
Y
129
ADD TD TTFL=X + TD
130
SUBTRACT TD TTFL= X-TD
118
CLEAR ALL FLAGS
119
SET TIME TILL FLASH (TTFL) FLASH FLAGS
LONG: 000300-FFFFFF
MID 2: 000200-0002FF
MID 1: 000100-0001FF
SHORT: 000000-0000FF
120
SET FLASH READY
121
END SUB.

DIGITAL TIMING LIGHT

BACKGROUND OF THE INVENTION

The present invention relates to engine timing apparatus for measuring the advance/retard time delay of a multi-cylinder internal combustion engine.

It is conventional practice in the tuning of internal combustion engines to measure the advance or retard angle of the engine and adjust the angle to predetermined specifications. In this regard, a visible timing mark is provided on the engine flywheel, and a stroboscopic lamp or "timing light" is directed at the flywheel to illuminate the the timing mark. The timing light is energized under the control of ignition pulses from the ignition system, so that timing mark appears to be stationary when illuminated by the timing light. By adjusting the time delay between the ignition pulse and the firing of the timing light, the timing mark on the flywheel can be made to appear to align with a fixed mark on the engine block which corresponds to a predetermined position of the engine, typically the top dead center position of the piston in the cylinder from which the ignition pulses are being derived. The amount of time delay adjustment is indicative of the advance or retard angle of the engine.

In a gasoline engine, ignition is caused by a spark, and typically occurs before the piston reaches the top dead center position. Thus, the angle between the position of the flywheel at the point of ignition and at the top dead center position is referred to as an "advance" angle. In diesel engines, the ignition results upon injection of fuel into a cylinder heated by compression, and typically occurs a short time after the top dead center position. Thus, the angle between the position of the flywheel at ignition and top dead center is referred to as a "retard" angle.

In prior engine timing apparatus, it is common to have a metered timing light with an adjustment knob. In such an apparatus, the user adjusts the delay of the flash until the timing marks on the engine are aligned and then reads the advance or retard angle from the meter. If the angle is not according to specifications, the necessary adjustments on the engine are made. But the time delay will vary with engine speed and, therefore, at a different engine speed the meter will read a different advance/retard angle.

It is known to provide timing lights which are meterless, but which have adjustment dials which are calibrated in degrees of advance or retard angle. In such systems, the operator dials the desired advance/retard angle and the system generates the necessary delay, which automatically varies in response to changes in engine speed. One such system is disclosed in U.S. Pat. No. 4,095,170. However, that system is an analog system and, therefore, does not permit very accurate adjustment of the advance/retard angle. Furthermore, it is capable of generating only advance delays and, therefore, cannot readily be used with diesel engines.

Another such system is disclosed in U.S. Pat. No. 4,472,779, which is a digital system and can register advance and retard angles. However, the device of this patent is a large, complicated engine analyzer disposed in a floor-mounted cabinet. It is very expensive and not portable. Furthermore, this system requires, in addition to a connection to the test cylinder, a connection to the high tension lead, i.e., the coil tower wire, which may not be directly accessible in many engines. Also, the system requires the operator to know how many cylinders are in the engine and to enter that information into the system. Finally, this system is not readily adaptable for use on diesel engines since, while it is capable of registering retard angles, it may not be able to register them over a full range of from 0° to −180°. This is because the system operates in such a way that the retard angle is limited to the number of degrees between adjacent cylinders.

Finally, all of the prior systems suffer from inaccuracies resulting from inherent system delays. Thus, all of these systems require a finite time to respond to the ignition signal, this delay varying with the hardware and/or software being used. Even microprocessor-based digital systems may require anywhere from 50 to several hundred microseconds to respond. This error may not be significant when the engine is operating at relatively low speeds, but may be very significant at high speeds. For example, if the engine is operating at 9,000 rpm, the advance or retard angle may represent a delay of only 100 or 200 microseconds. At this speed, an error of only 50 to 100 microseconds would be very significant.

SUMMARY OF THE INVENTION

It is a general object of the present invention to provide an improved engine timing apparatus which avoids the disadvantages of prior timing devices while affording additional structural and operating advantages.

An important feature of the invention is the provision of a timing apparatus which requires only a single connection to the engine being timed.

Another feature of the invention is the provision of a timing apparatus which is readily adaptable for use with either gasoline or diesel engines.

Still another feature of the invention is the provision of a timing apparatus which is extremely accurate even at high engine speeds.

In connection with the foregoing feature, another feature of the invention is the provision of an engine timing apparatus of the type set forth, which automatically compensates for inherent system delays.

Yet another feature of the invention is the provision of a digital timing apparatus which is hand-held and portable, and which automatically varies the advance/retard delay with engine speed.

These and other features of the invention are attained by providing digital engine timing apparatus for use in testing a multi-cylinder internal combustion piston engine having a control system for sequentially providing fuel ignition in the engine cylinders in a predetermined order, the timing apparatus comprising: timing light means for providing a light pulse in response to an electrical trigger pulse; pickup means responsive to each ignition in a selected cylinder for generating a pickup signal; operator-actuated means for selectively producing a variable angular value representative of an angular relationship between ignition in the selected cylinder and a predetermined position of the associated piston; and processor means operating under stored program control, the processor means including timing means for generating digital data corresponding to the time period between consecutive pickup signals, means for calculating from only the angular value and the digital data corresponding to the time period a time delay value corresponding to the angular value, and means for producing the trigger pulse at a time spaced from the pickup signal by a predetermined function of the time delay value.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

FIGS. 3–12 are a flow chart of the program for controlling the microprocessor of the circuit of FIG. 2.

DESCRIPTION OF THE PREFERRED EMBODIMENT

Figure 1:
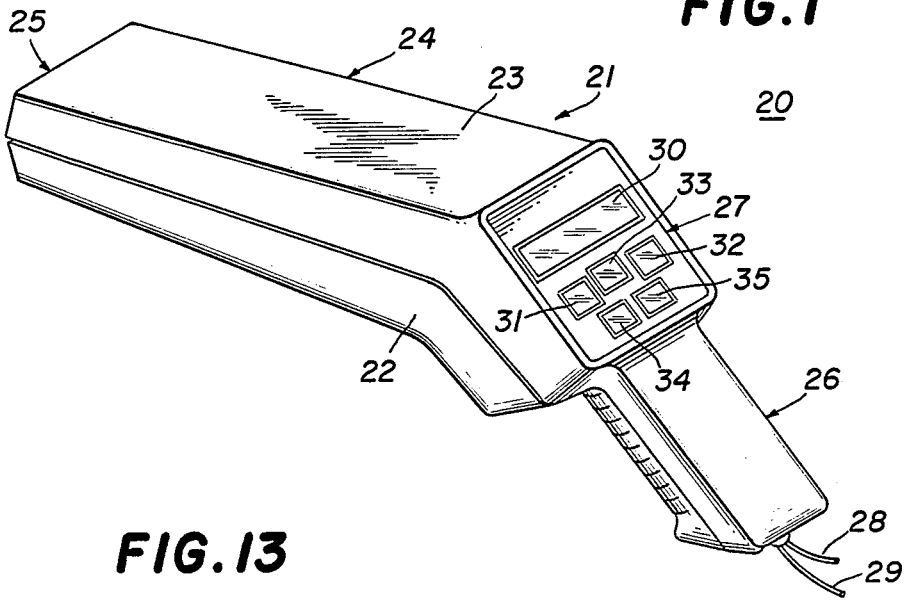
FIG. 1 is a perspective view of a timing light constructed in accordance with and embodying the features of the present invention.

Referring to FIG. 1, there is illustrated a digital timing light 20, constructed in accordance with and embodying the features of the present invention. The timing light 20 has a pistol-type housing 21 of two-part construction, including a base 22 and a cover 23. These parts define an elongated body 24 terminating at a tip 25 in which a lamp 75 is mounted (see FIG. 2). A handle 26 projects from the other end of the body 24 and a rectangular control panel 27 is disposed between the handle 26 and the body 24. Extending from the distal end of the handle 26 is a power cable 28, which may include positive and ground conductors, and a pickup cable 29 adapted to be coupled to the associated engine to be timed. The control panel 27 includes an LED display 30 and a keyboard including a reset key 31, a flash key 32, a tachometer/advance selector key 33, a decrement key 34 and an increment key 35.

Figures 2, 2A:
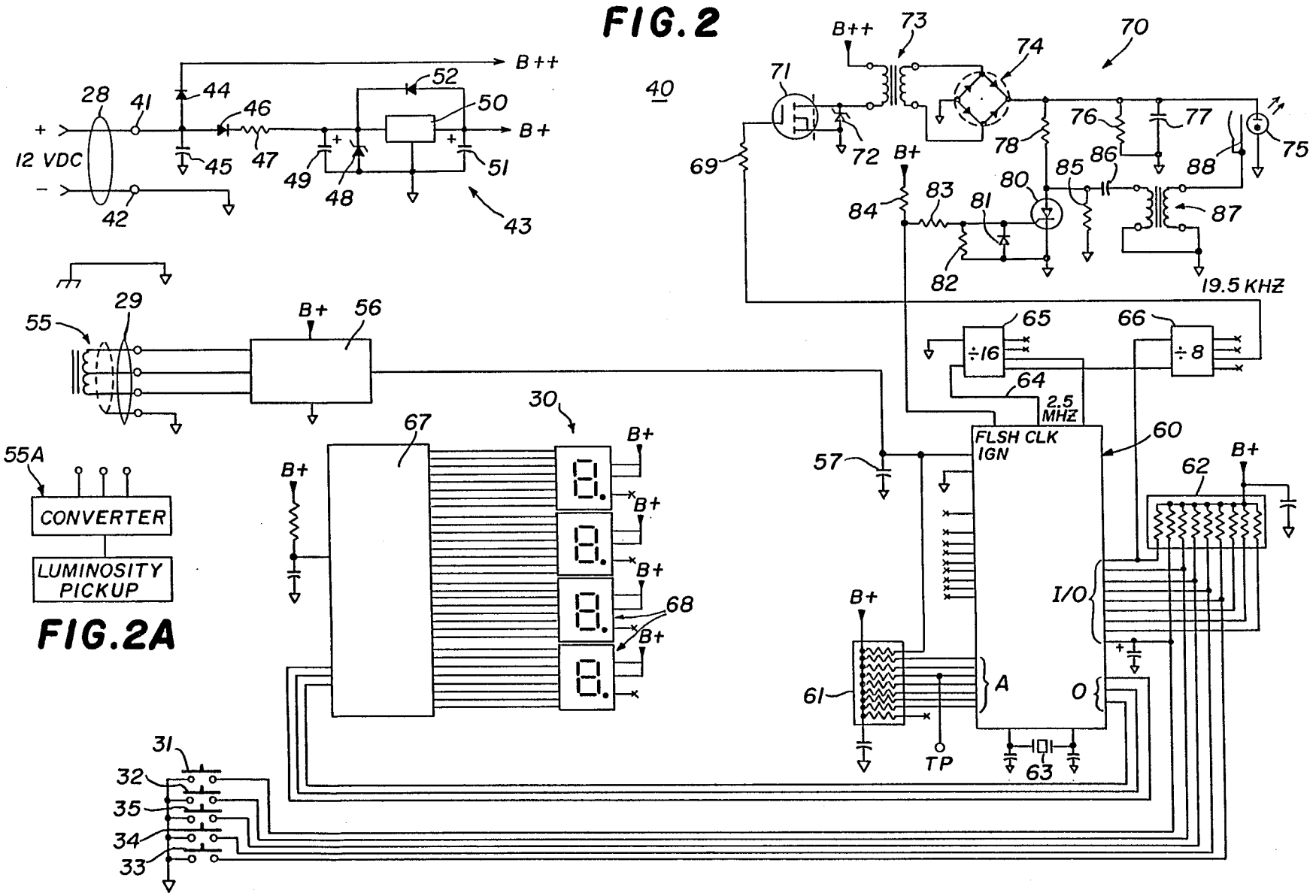
FIG. 2 is a schematic diagram of the control circuitry of the timing light of FIG. 1.
FIG. 2A is an alternative pickup to that of FIG. 2.

Referring to FIG. 2, there is illustrated a control circuit 40 for the timing light 20, which is disposed within the housing 21. The circuit has a positive input terminal 41 and a grounded negative input terminal 42, which are respectively connected to the positive and ground conductors of the power cable 28, which is in turn adapted to be connected to a suitable source of 12 VDC power, such as that provided by the automobile battery.

The input terminal 41 is connected to a power supply 43. In particular, the terminal 41 is connected to the anode of a diode 44, at the cathode of which there is produced a B++ supply voltage, typically 12 volts. The terminal 41 is also connected to a capacitor 45 which shunts high frequency to ground. A diode 46 and a resistor 47 are connected in series between the input terminal 41 and the cathode of a Zener diode 48, the anode of which is grounded, a capacitor 49 being connected in parallel with the Zener diode 48. The cathode of the Zener diode 48 is connected to the input terminal of a linear voltage regulator integrated circuit (IC) 50, at the output terminal of which there is produced a B+ supply voltage which may be 5 VDC. The IC 50 may be of the type designated 7805. A capacitor 51 is connected across the output and ground terminals of the IC 50, while a feedback diode 52 is connected between the output and input terminals of the IC 50.

The timing light 20 includes an inductive pickup coil 55 which is connected to the distal end of the pickup cable 29, which is preferably a shielded cable, and the other end of which is connected to the input terminals of an inductive pickup IC 56. The IC 56 may be of a type manufactured by Centralab, Inc. and which operates as a comparator which triggers at a specified voltage. The inductive pickup coil 55 is adapted for use with gasoline engines and is, in use, coupled to the spark plug wire for the cylinder of interest, typically the No. 1 cylinder. An important aspect of the present invention is that the timing light 20 can also be used for timing diesel engines. In that event, a luminosity pickup 55A is substituted for the inductive pickup coil 55, FIG. 2A shows the luminosity pickup 55A typically being inserted in place of the glow plug in the cylinder of interest and operating to convert the luminosity signal to an inductive signal to be applied to the input of the IC 56.

The output of the IC 56 comprises an ignition or pickup signal which is applied to a shunt capacitor 57 and to the ignition input pin IGN of an IC microcontroller 60, which may be a TMS7042, made by Texas Instruments Incorporated. The ignition signal from the output of the IC 56 is also applied to one terminal of a resistive termination pad 61, which is utilized to terminate the pins of an input port A of the microcontroller 60, which pins, in the present embodiment, are not utilized. The termination pad 61 simply ties down these inputs so that they are not floating. Similarly, a termination pad 62 ties down the unused pins of an I/O port of the microcontroller 60. An external crystal 63 is coupled to clock input pins of the microcontroller 60, the crystal 63 preferably having a frequency of 5 MHz. The microcontroller 60 generates a 2.5 MHz clock output signal on conductor 64 at its pin CLK, which signal is divided by 16 and then by 8 in IC's 65 and 66, respectively, to produce a 19.5 kHz output signal. The IC's 65 and 66 may be dual 4-bit binary counters. The microcontroller 60 also generates a flash trigger output signal at the pin FLSH. The microcontroller 60 has an output port O which is coupled to the input of a display control IC 67, such as an MM5450 made by National Semiconductor Corporation, which in turn controls four alphanumeric LED display chips 68. While the display chips 68 are illustrated in FIG. 2 as being aligned vertically, it will be appreciated that, in use, they are aligned horizontally in the display 30, as can be seen in FIG. 1.

The 19.5 kHz clock signal from the divider IC 66 is applied to a high voltage circuit 70, which is similar to that disclosed in copending U.S. application Ser. No. 789,474, filed Oct. 21, 1985, entitled "Capacitor Charging Circuit for Timing Light Power Source", and assigned to the assignee of the present invention, the disclosure of which application is incorporated herein by reference.

More particularly, the 19.5 kHz signal comprises an oscillator input which is applied through a resistor 69 to the gate electrode of an electronic switch, preferably a metal oxide semiconductor field effect transistor (MOS- FET) 71. The source electrode of the MOSFET 71 is grounded and a breakdown diode 72 is connected between the drain electrode of the MOSFET 71 and ground. Preferably, the diode 72 is a unidirectional transient voltage suppressor of the type sold by Motorola, Inc. under the trademark "MOSORB". The MOSFET 71 is connected in series with the primary winding of a transformer 73 between the B++ supply and ground. The secondary winding of the transformer 73 is connected across the input of a full wave rectifying diode bridge 74, the output of which is connected to the anode of the lamp 75, the cathode of which is grounded.

Connected in parallel with the lamp 75 and with each other are a capacitor 77 and a resistor 76. The output of the diode bridge 74 is also connected through a resistor 78 to the anode of an SCR 80, the cathode of which is grounded. A diode 81 and a resistor 82 are connected in parallel across the gate electrode and cathode of the SCR 80. The trigger signal from the FLSH pin of the microcontroller 60 is applied to the gate electrode of the SCR 80 through a resistor 83, and is coupled through a resistor 84 to the B+ supply. The anode of the SCR 80 is also connected through a resistor 85 to ground and through a capacitor 86 to the primary winding of a pulse transformer 87, the secondary winding of which is coupled to a trigger electrode 88 of the lamp 75.

In operation, the rectangular 19.5 kHz signal energizes the MOSFET 71, producing current pulses in the transformer 73, thereby producing on the secondary winding thereof high voltage pulses which are rectified in the diode bridge 74. The rectified voltage pulses charge the capacitors 77 and 86, the former being charged rapidly because there is very little charging resistance, and the latter being charged more slowly through the resistor 78. The capacitor 77 maintains a charge of about 650 volts on the anode of the lamp 75. In response to sensing of an ignition pulse by the pickup coil 55, a trigger pulse is applied by the microcontroller 60 to the gate of the SCR 80, causing it to fire, thereby discharging the capacitor 86. The circuit values are such that the discharge of the capacitor 86 through the SCR 80 places across the primary winding of the transformer 87 a voltage, which is transformed to about 10 KV on the secondary. This high triggering voltage is applied to the trigger electrode 88, which ionizes the gas in the lamp 75 to cause it to fire, discharging the capacitor 77 through the lamp 75. The resistor 78 serves to isolate the capacitor 77 so that it can discharge only through the lamp 75 and not through the SCR 80. The resistors 76 and 85 serve, respectively, to discharge the capacitors 77 and 86 when the timing light 20 is turned off.

The lamp 75 can flash only when the capacitor 77 is charged. If the capacitor 77 is not fully charged, then there will be insufficient voltage on the anode of the lamp 75 to fire it. Preferably, the time constant is selected so that if the engine speed is greater than 4577 rpm, the pulses on the inductive pickup coil 55 come too rapidly to charge the capacitor 77 between pickup pulses, so the lamp 75 flashes only every other pulse, a condition referred to hereinafter as "autoranging".

The control circuit 40 operates under the control of a software program stored in a ROM in the microcontroller 60, which program will now be explained in connection with the flow chart 90 of FIGS. 3–12 and the timing diagrams of FIGS. 13A–G. Initially, the power cable 28 is coupled to the associated automobile battery, and the inductive pickup coil 55 is coupled to the No. 1 sparkplug wire. Power is on once the circuit is connected to the battery, and the program 90 is initiated by pressing the reset key 31.

Initializing

Referring to FIG. 3, the program first clears the RAM at step 91 and then, at step 92, initializes the circuitry, sets the counter/timer overflow, sets the system to a 0° advance angle, sets the "no autoranging" flag and sets the "Logo mode" flag. The Logo mode is a standby mode wherein a set indicium, which may be the logo of the manufacturer, is continuously scrolled across the display 30 (see FIG. 1).

The program is capable of operating in a number of different program versions, depending upon connections to the input port A of the microcontroller 60. These different versions may include different functions. At step 93, the program samples input port A to determine which version is being used. In a preferred form of the invention, a version A would permit the advance delay limits to be set anywhere between −180° and +180°, while a version B would permit the advance delay limits to be set only between 0° and +180°. At step 94, the program asks whether it is in version A and, if it is, sets the advance delay limits accordingly at step 95. If it is not in version A, the program proceeds to step 96 to ask if it is in version B. If it is, it sets the advance limits accordingly at step 97, and if it is not, it proceeds to a stop or idle condition at step 98. It will be appreciated that at this point the program could branch to consider additional possible versions of the system.

Figure 13:
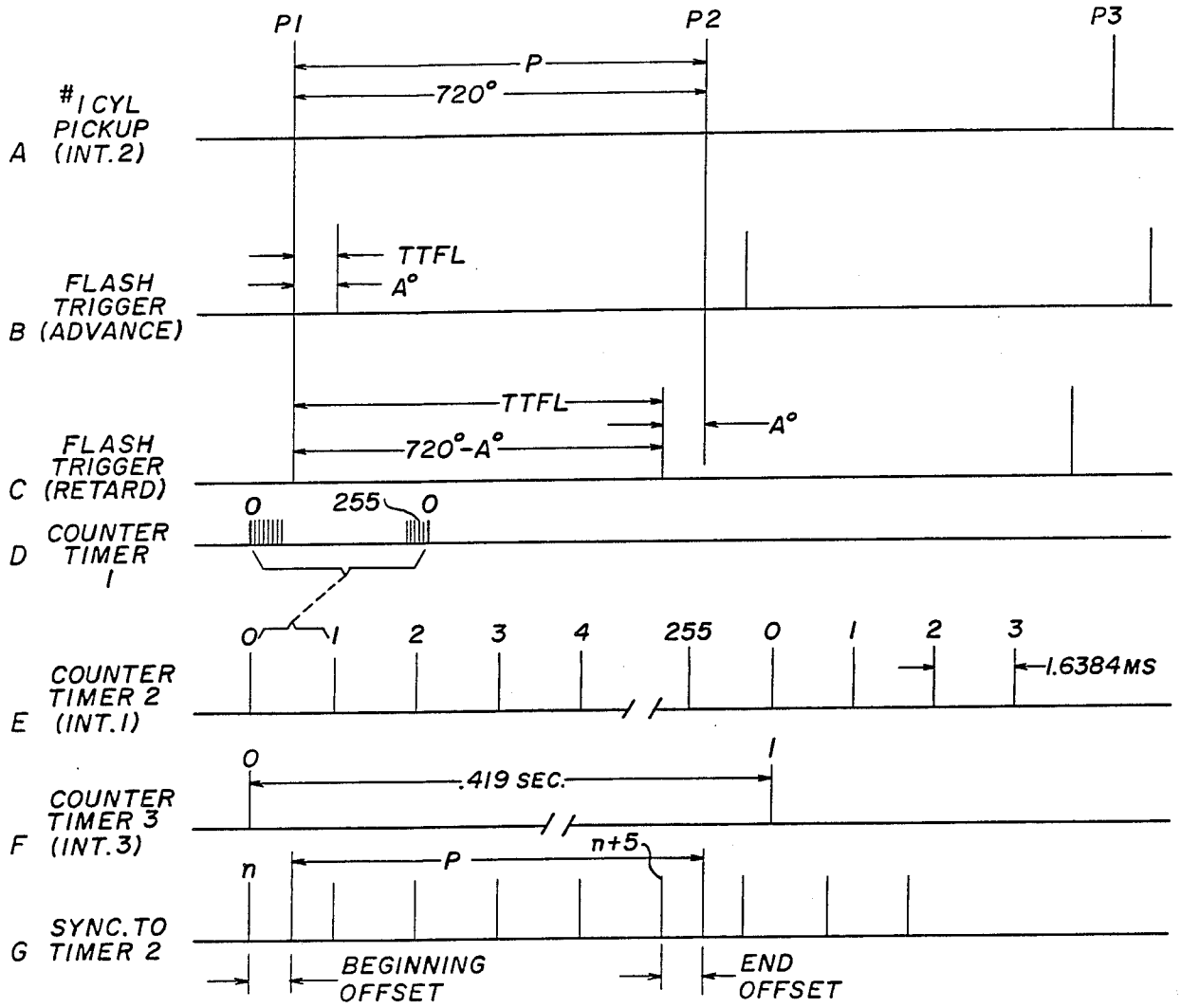
FIG. 13 shows timing waveform diagrams illustrating certain timing relationships in the operation of the system of FIG. 2.
Figure 4:
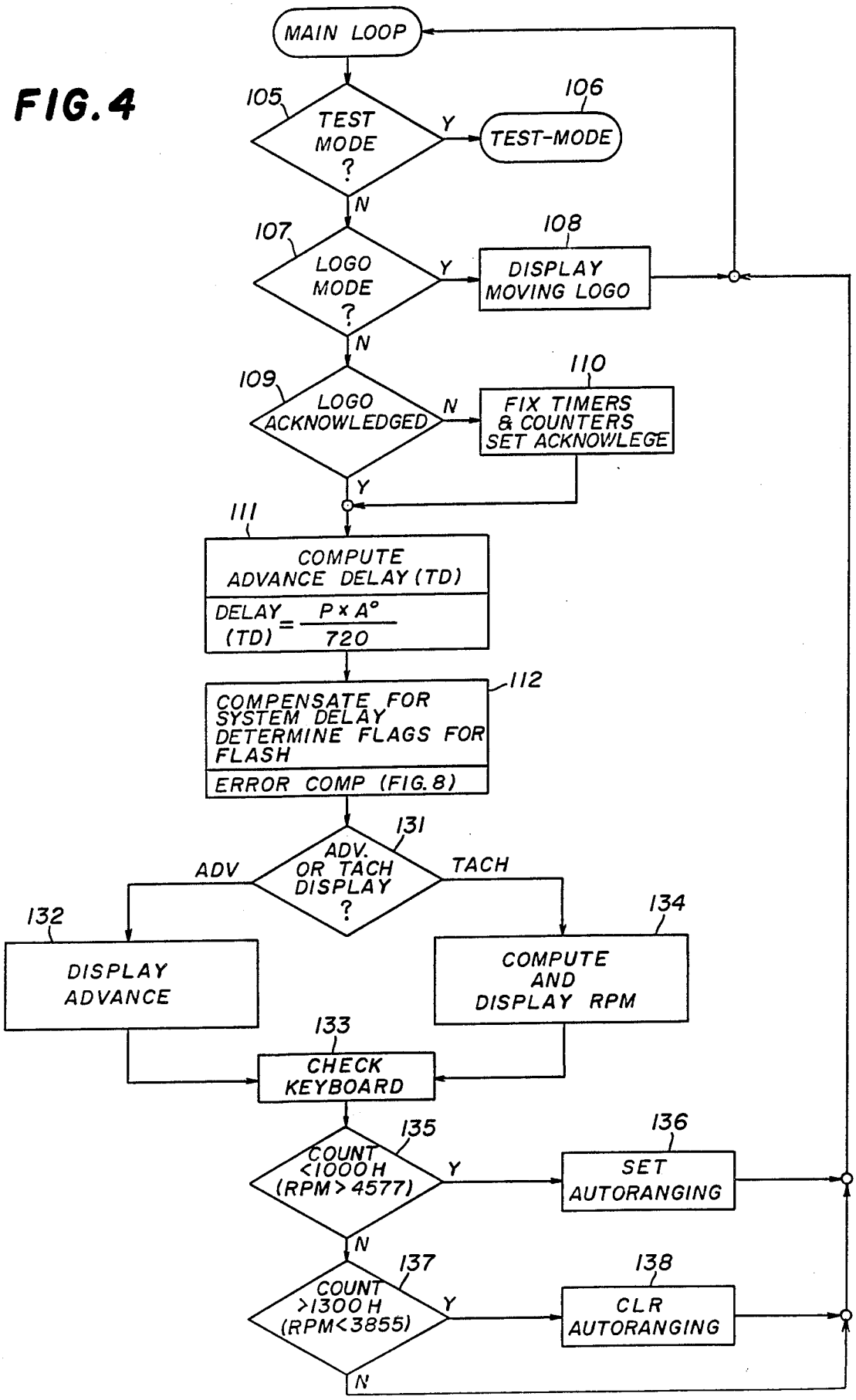

After the advance angle limits have been set in accordance with the appropriate version, the program proceeds to step 99 where it initializes the stack pointer and the peripheral expansion mode, enables the Timer 2 Interrupt and the ignition Interrupt (Interrupts 1 and 2) (FIGS. 5 and 6), starts Timer 1, which is a counter operating at a rate of 6.4 microseconds per count (see FIG. 13, waveform D), enables a second timing Interrupt (Interrupt 3) and starts Timer 2, which is cascaded from Timer 1, i.e., each time the Timer 1 overflows, it generates a count in Timer 2, causing the Interrupt 1 to occur (FIG. 13, waveform E). Each time Timer 2 overflows, it causes the Interrupt 3 to occur (FIG. 13, waveform F). The Interrupt 2 occurs each time a pickup signal is received from the No. 1 cylinder. After the Timers have been started, the program enables the display 30 at step 100, resets the display 30 at step 101 and, at step 102, causes it to display the current version (A or B) of the system. The program then, at step 103, initializes the keyboard data direction, turns on the high voltage circuit 70 by enabling the counter 66 and globally enables all the individual Interrupts. The initialization routine having been completed, the program then proceeds at step 104 to the main loop of the program, which is shown in FIG. 4.

Keyboard Functions

The display 30 of the timing light 20 can be operated in either a Tachometer mode or an Advance mode. In the former, the control circuit 40 simply operates as both a tachometer and a timing light. It measures engine speed by measuring the time between pickup pulses from the No. 1 cylinder and displays the computed engine speed. In the latter mode, the control circuit 40 operates simply as a timing light, and calculates the advance time delay between the pickup pulse and the flashing of the lamp 75. The display 30 shows the desired advance or retard angle in degrees. The operator selects the desired mode by operation of the key 33, which operates as a toggle switch, alternately switching the mode each time the key is pressed.

If the timing light 20 is being operated in the Advance mode, the user must key in the desired advance or retard angle in degrees. Initially, the system is set to a 0° advance angle, and a user can increment or decrement this initial advance angle by operation of the increment and decrement keys 35 and 34, respectively. Each time the key 35 is momentarily depressed, it increments the advance angle by 1°, and each time the key 34 is momentarily pressed, it decrements the existing advance angle by 1°. If either key 35 or 34 is held down, it will rapidly increment or decrement the advance angle. The display 30 displays the current angle with the appropriate plus or minus sign. Any time the reset button 31 is pressed, the display will return to 0°. By the use of the flash key 32, which acts as a toggle switch, the user can selectively turn the high voltage circuit 70 on and off. When it is off, the lamp 75 is effectively disabled. The user may wish to turn off the high voltage circuit 70, for example, when the timing light 20 is operating in the tachometer mode.

Main Loop

Once initialized, the program will continuously cycle through the main loop (FIG. 4), until it is interrupted by one of the Interrupts 1, 2 or 3. First, the main loop proceeds to step 105 where it asks if the system is in the Test Mode. If it is, it proceeds to execute that mode at step 106. This is a self-test mode of operation which is actuated by connecting a test probe to a designated point TP at the input port A of the microcontroller 60 (FIG. 2). If the program is not in Test Mode, it proceeds to step 107 to ask if the Logo mode flag has been set. In this case it has, since it was set during the initialization procedure in FIG. 3. Thus, the program proceeds to step 108 to display the moving logo and returns to the beginning of the main loop. The loop will continue displaying the moving logo until the Logo mode flag is cleared, which will happen when the first pickup pulse occurs, as will be explained below in connection with Interrupt 2.

The program then proceeds to step 109 to ask if the logo has been acknowledged. The first time through it has not, so the program proceeds to step 110 to fix the timers and counters and to set the acknowledge flag. The program then proceeds to step 111 to compute the advance time delay (TD), i.e., the time from the last pickup pulse until the lamp 75 is to be flashed. It will be appreciated that the next time through the main loop the program will proceed directly to this step, since the logo acknowledged flag has now been set in step 110.

For purposes of the computation in step 111, it is assumed that the advance angle is not less than 0°. Referring to FIG. 13, waveform A represents the pickup pulses received from the No. 1 cylinder of the engine. It will be appreciated that the period P of these pulses will vary with the speed of the engine. In a typical gasoline engine, the crank shaft will rotate through two complete revolutions or 720° for each engine cycle between two consecutive firings of the spark plug for that cylinder. The number of Timer 1 counts during the period P is determined, and that value (counts per cycle) is multiplied by the advance angle in degrees which was keyed in by the user, and divided by 720° per cycle. There results a time delay period TD corresponding to the advance angle A°, and illustrated in waveform B of FIG. 13. Since the time period P between pickup pulses varies with the engine speed, it can be seen that the program automatically adjusts the computation of the advance time delay TD for changes in engine speed. Thus, each time the program traverses the main loop, it updates the calculation of TD based upon the current value of P.

The program must then proceed to generate the necessary trigger signal for flashing the lamp 75 at the desired advance time delay after the last pickup pulse. But, it will be understood that this does not all happen instantaneously. Rather, it requires a certain finite time period for the program to compute the advance time delay and then generate the necessary trigger signal. Thus, if the computed advance time delay TD were utilized, by the time the program instructed the microcontroller 60 to start counting down the relay, the inherent system delay would have already occurred. Thus, the actual time delay between the pickup pulse and the flashing of the lamp 75 will be TD plus the system delay and will, therefore, be inaccurate to the extent of the system delay.

ERROR COMP Routine

It is a fundamental aspect of the present invention that it automatically compensates for this system delay at step 112, by subtracting it from the calculated advance time delay TD to obtain a corrected time till flash (TTFL) value. It does this by performing the ERROR COMP routine set forth in FIG. 8. First of all, at step 113, the program saves the last computed TTFL value and clears the Flash-Ready flag. The last TTFL value is saved in case an Interrupt occurs during the ERROR COMP routine, so that the program will be able to flash the lamp 75 based upon this last-computed TTFL value. The program then proceeds to step 114 to ask if the user-selected advance angle is greater than 0°. If it is, then the program proceeds to step 115 to move the last-computed advance time delay value TD into the flash. Then at step 116, the program subtracts the constant software system delay error from TD. Next, at step 117, the program asks if a borrow has occurred, i.e., whether or not the advance time delay value has become negative as a result of the subtraction of the system delay error. This is possible at high engine speeds or where the advance angle is 0° or very small, so that the advance time delay TD may be less than the system delay.

If no such borrow has occurred, the program proceeds directly to step 118 to clear all flags, and then to step 119 to set the Short, Mid 1, Mid 2, and Long TTFL flags. A Short TTFL corresponds to a time period which is less than one count of the counter Timer 2 (waveform E of FIG. 13), i.e., between 0 and 255 counts of the counter Timer 1 (waveform D of FIG. 13). A Mid 1 TTFL is a time period in the range from 1 to 2 counts of the Timer 2, a Mid 2 TTFL is a time period in the range from 2 to 3 counts of the Timer 2, and a Long TTFL is anything longer than 3 of the Timer 2 counts. These various time periods are represented by their hexadecimal number designations in step 119. As can be seen in waveform E of FIG. 13, the time between consecutive counts of the Timer 2 counter is approximately 1.6384 ms. The program then sets the Flash-Ready flag at step 120 and then ends the subroutine at step 121 to move to the next step of the main loop.

If a borrow had occurred at step 117, the program would proceed to step 122 to ask if the engine is operating at a low speed, i.e., less than 1927 rpm. If it is, the program sets the advance angle at 0° at step 123 and clears the TTFL value at step 124 to proceed directly to step 118. In other words, if the engine is operating at a low speed, the only way the borrow could have occurred at step 117 is if the advance angle A° was at or very near 0°. Thus, it can be assumed to be 0° and, since the system delay error will be insignificant at this low speed, it can be disregarded.

If the engine speed is not low, then the system delay error which caused the borrow at step 117 may be significant, so the program proceeds to step 125 to clear the 0° advance. The program then moves to step 126, to which it would have moved directly if the advance angle A° had initially been found to be not greater than 0° at step 114. At step 126, the program moves the total P time period between consecutive pickup pulses into the flash and then, at step 127, subtracts the constant software time delay error to produce an intermediate value X. The program then asks at step 128 if the advance angle A° is greater than 0°. If it is, the calculated advance time delay TD is added at step 129, and if it is not the TD value is subtracted at step 130, whereupon the program proceeds to step 118.

The computations performed at steps 126–130 are illustrated at waveforms B and C of FIG. 13. Waveform B illustrates a positive advance angle, i.e., the pickup pulse P1 precedes the flash by the advance angle A°. In this case the corrected advance delay TTFL is defined by the relationship:

$$TTFL=(A°/720°)P-ERROR$$

where ERROR is the system delay. This computation is performed when the program proceeds via step 129. The ERROR value is not shown, since it is too small to be visible at the time scale of the diagram. Waveform C illustrates a negative advance angle or retard angle A°. In this case the pickup pulse follows the lamp flash. But since the computation was based on the first pickup pulse P1, the retard angle must be applied to the next pickup pulse. Thus, the corrected retard delay is defined by the relationship:

$$TTFL=[(720°-A°)/720°]P-ERROR.$$

This is the computation which takes place when the program proceeds via step 130.

When the ERROR COMP routine is completed, the main loop (FIG. 4) then proceeds to step 131 to check the state of key 33 to see if the system is in the Advance mode or the Tachometer mode. If the former, the program proceeds to step 132 to display the advance angle A° and then to step 133 to check to see if any keys have been pressed since the last circuit through the main loop. If the system is in the Tachometer mode, the program will proceed from step 131 to step 134 to compute and display the engine speed in rpm. Since the engine goes through two revolutions for each period P between consecutive pickup pulses, and since the period P in seconds is determined by the number of counts of the timer T1×6.4 microseconds per count, the engine speed in rpm is determined by the relationship:

$$RPM = (2 \text{ revs.}/P \text{ secs.}) \times (60 \text{ secs./min.})$$

-continued $$= [120/(\text{No. of counts} \times .0000064)] \text{ revs./min.}$$

$$= [18{,}750{,}000/\text{No. of counts}] \text{ revs./min.}$$

The program then again proceeds to step 133.

Next the main loop proceeds to step 135 to ask if the engine speed is greater than 4577 rpm. If it is, the program sets the "autoranging" flag at step 136 and repeats the main loop. If it is not, the program proceeds to step 137 to ask if the engine speed is less than 3855 rpm. If it is not, the program immediately returns to the beginning of the loop. If the speed is less than 3855 rpm, the program first clears the "autoranging" flag at step 138 before repeating the loop. Thus, it will be appreciated that once the program goes into the "autoranging" mode it will not drop back out until the engine speed drops all the way to 3855 rpm. This is to provide a hysteresis buffer range so that the system cannot flicker back and forth in and out of the "autoranging" mode in the event that the engine speed is rapidly fluctuating near 4577 rpm.

Timers

In normal operation, the program will continually cycle through the main loop until one of the Interrupts occurs, at which point the program will momentarily drop out of the main loop to perform the Interrupt routine and will then return to the main loop at exactly the same place that it dropped out. Interrupts 1 and 3 are part of a system counter, and are respectively illustrated in FIGS. 5 and 12. The counter comprises Timers 1, 2 and 3, which are respectively illustrated in waveforms D, E and F of FIG. 13. Each Timer is an 8-bit counter. Timer 1 has been previously described, and produces a count every 6.4 microseconds. When the count in Timer 1 reaches 256, it overflows and returns to 0, and the overflow creates a count in Timer 2. Thus, Timer 2 produces a count every 1.6384 ms. and each of these counts triggers Interrupt 1. When the Timer 2 count reaches 256, it overflows to produce a count in Timer 3, and trigger Interrupt 3. Thus, the Interrupts 1 and 3 occur at regular intervals. As can be seen in FIG. 12, for each Interrupt 3 the program simply checks at step 139 to see if it is in the Logo mode. If it is not it increments the high byte of the timer (Timer 3) at step 140 and then returns to the main loop at step 141. If the system is in the Logo mode, the program simply returns immediately to the main loop.

An Interrupt 2 is triggered by each pickup pulse from the No. 1 cylinder and, therefore, may occur at any time. Each time the Interrupt 2 occurs, the system must, at the TTFL period thereafter, generate a trigger pulse for the lamp 75. Therefore, in general, during Interrupt 2 the program checks to see how long this TTFL period is. If it is relatively short, the program operates to generate the flash trigger pulse during the current Interrupt 2. If TTFL is relatively long, i.e., more that 3 counts of Timer 2, the program transfers control of the flash triggering function to the Interrupt 1 routine, after first synchronizing Timer 2 to the pickup pulse. Then each Interrupt 1 routine thereafter will check to see if it is the proper time for generating the trigger pulse and, when it is, will initiate the trigger pulse generation. Trigger pulse generation, whether controlled by Interrupt 1 or Interrupt 2, is effected by the TRIGGER subroutine of FIG. 9. If the control of trigger pulse generation has been transferred to Interrupt 1, each Interrupt 1 will increment an elapsed time counter using the INC-TIME routine of FIG. 11, until the time when the trigger pulse is to be generated. After the flash trigger pulse is generated, the current computed TTFL delay period will be reloaded using the RELOAD routine of FIG. 10.

Interrupt 2

Referring to FIG. 6, the Interrupt 2 routine will now be described. Upon initiation of Interrupt 2, the Timer Interrupts 1 and 3 will be disabled. At step 142, the program checks to see if the engine is running at a low rpm and if the advance angle is 0°. If it is, then as explained above, the system delay error can be ignored and the program proceeds to step 143 to turn the flash pulse on immediately. Then, the program proceeds to step 144 to capture the current Timer 2 value. If the answer at step 142 is NO, the program proceeds immediately to step 144. Then, the program drops to step 145 to ask if the current corrected advance delay time TTFL is Short, i.e., less than 256 counts of Timer 1 (less than 1.6384 ms). If it is, the program proceeds to step 146 to generate the flash trigger pulse at the appropriate time or go into the "autorange mode", if appropriate, using the TRIGGER subroutine of FIG. 9.

TRIGGER Subroutine

Figure 9:
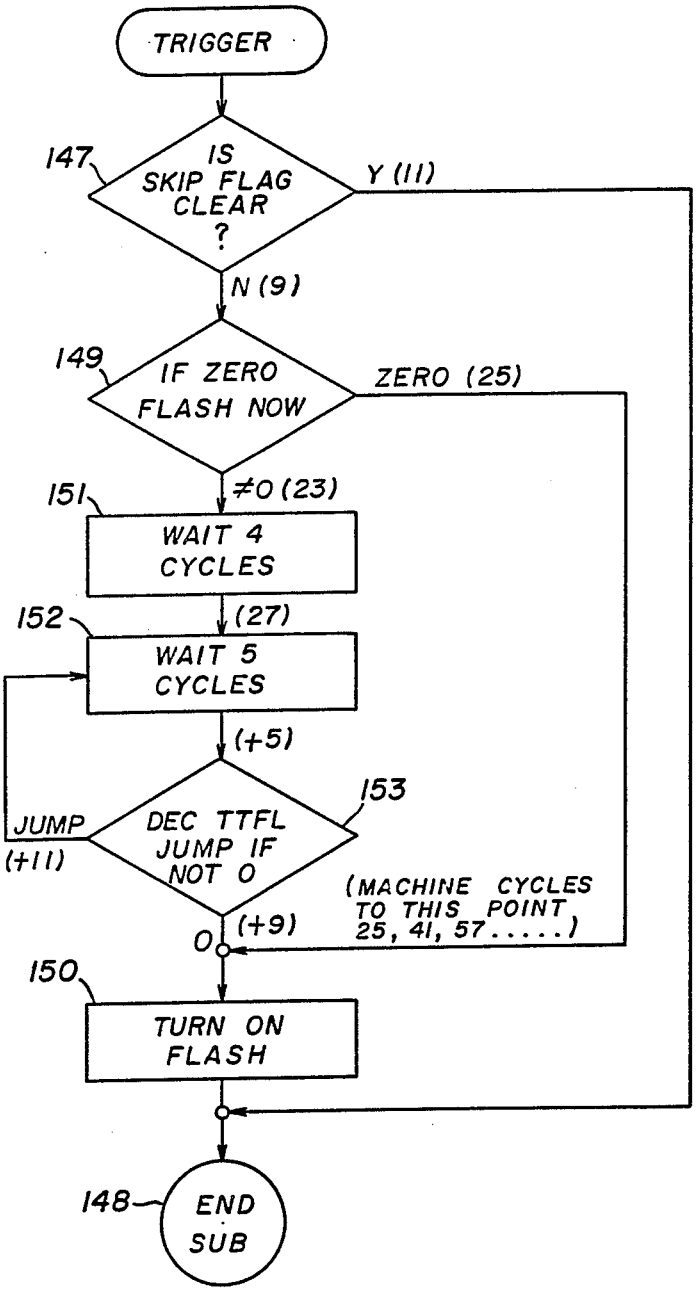
Figure 10:
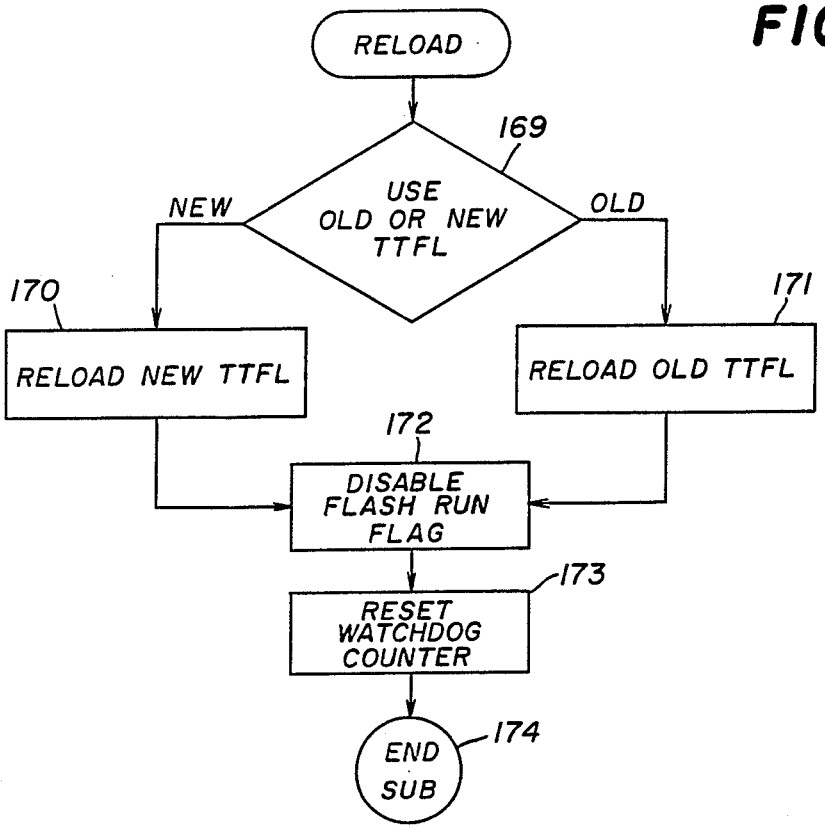
Figure 11:
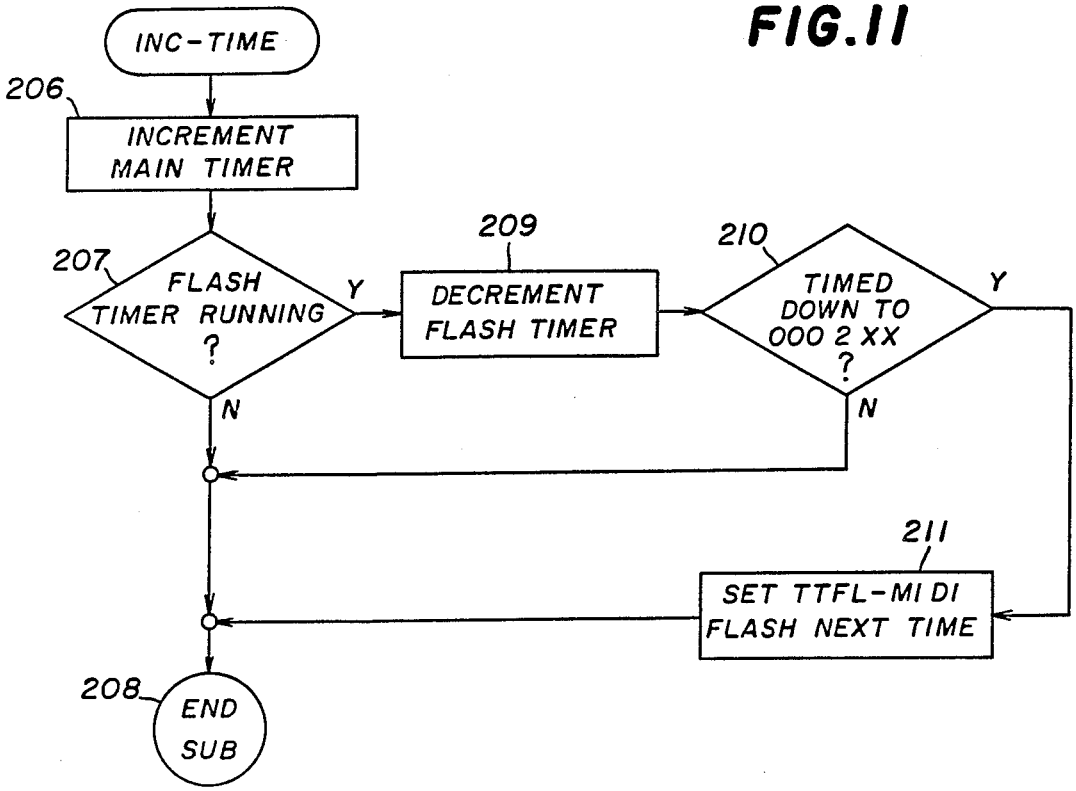

Referring to FIG. 9 the program first asks at step 147 if the "skip" flag is clear. This flag will be clear if the system is in the "autorange mode", i.e., if the engine speed is greater than 4577 rpm, as will be explained below in connection with the SAVE-CNT Subroutine of FIG. 7. If the flag is clear, then the lamp is not to flash on this pickup pulse, but rather on the next one and on alternating pulses thereafter, so the program drops immediately to step 148 to end the subroutine. The numbers in parenthesis in FIG. 9 indicate the number of machine cycles required to execute the subroutine to that point. For the particular microcontroller 60 being used in the preferred embodiment, one machine cycle equals 400 ns, so that one count of Timer 1 requires 16 machine cycles.

If the system is not in the "autorange mode" the "skip" flag will not be set, and the program drops to step 149 to ask if TTFL is 0. If it is, the program proceeds directly to step 150 to generate the flash trigger pulse immediately. The subroutine requires 25 machine cycles to effect this immediate turn-on of the flash, and this represents part of the system delay error described above.

If TTFL is not 0, the subroutine pauses at steps 151 and 152 for four machine cycles and five machine cycles, respectively, and then moves to step 153, to decrement the TTFL value by one Timer 1 count and ask if TTFL is now 0. If it is, it proceeds to step 150 to turn on the flash. It can be seen that the time required to proceed from step 149 through step 153 totals 41 machine cycles, which exceeds the time required to proceed directly from step 149 to step 150, as described above, by 16 machine cycles or exactly one count of Timer 1. If, at step 153, TTFL is not 0, the program jumps back to step 152, consuming 11 machine cycles which, added to the 5-cycle delay at step 152, equals exactly 16 machine cycles or one count of Timer 1. Thus, the subroutine will continue cycling through steps 152 and 153 until TTFL reaches 0, decrementing Timer 1 by one count each cycle.

After the TRIGGER subroutine is ended, the Interrupt 2 routine then moves to step 154 to disable Interrupt 2 and set a flag indicating that Interrupt 2 has occurred.

If, at step 145, TTFL is not Short, the program moves to step 155 to ask if it is in the Mid 1 range, i.e., between one and two counts of Timer 2. If it is, the program proceeds to step 156 to wait for one Timer 2 count, and then back to step 146 to initiate the TRIGGER subroutine to generate the flask trigger pulse. If TTFL is not in the Mid 1 range, the program moves to step 157 to see if it is in the Mid 2 range, i.e., between two and three Timer 2 counts. If it is, the program moves to step 158 to wait for one Timer 2 count and then back through step 156 to wait for a second count and then to step 146 to initiate generation of the trigger pulse. If TTFL is not in the Mid 2 range, the program moves to step 159 to ask if it is in the Long range, i.e., greater than three Timer 2 counts. If it is not, the program moves to step 160 to enable the timer run and then to step 154. If TTFL is in the Long range, the program moves to step 161 to synchronize Timer 2 to the No. 1 pickup pulse.

The manner in which this synchronization occurs is illustrated in waveform G of FIG. 13. It can be seen that, typically, a pickup pulse (P1, P2, etc.) will not occur coincidentally with one of the Timer 2 counts (small pulses), but rather will occur between such counts. Thus, the period P will not normally be an even number of Timer 2 counts. In the illustrated example, the period P is 5 counts plus a beginning offset period before the first count, and an end offset after the last count. The synchronization in step 161 comprises subtracting from P the beginning offset period, so that the effective beginning of P is coincident with a Timer 2 count pulse. When this is accomplished, the program drops to step 162 to ask if the flash trigger is to be generated during the next Interrupt 1. If it is not, the program drops immediately to step 160, and if it is, the program first sets the Mid 1 delay range flag at step 163, then enables the Timer 1 at step 160 and then proceeds to exit Interrupt 2, control of the flash trigger generation having been now transferred to the Interrupt 1 routine.

After step 154, the program moves to step 164 to enable the Timer Interrupts 1 and 3 and then to step 165 to clear the Logo mode and then to step 166 to ask if the flash pulse is on. It will be on if it has been generated during this Interrupt 2, in which case the program moves to step 167 to turn it off, and then to step 168 to initiate the RELOAD subroutine of FIG. 10.

RELOAD Subroutine

That routine first moves to step 169 to ask whether an old or new value of TTFL should be utilized. Normally, the system will use the current or last-computed TTFL value. But if the Interrupt 2 had occurred during the recomputation, e.g., during step 112 of the main loop, that current value may be in the process of being changed. In that event, the step 169 tells the program to utilize the old TTFL value which was saved at step 113 in FIG. 8. The RELOAD subroutine then moves to step 170 or 171 to save the corresponding value of TTFL, and then to step 172 to disable the flash run flag. The subroutine then resets the Watchdog Counter (to be described below) at step 173 and then ends the subroutine at step 174.

Returning to FIG. 6, the Interrupt 2 routine returns to the main loop at step 175. If, at step 166, the flash had not been on, i.e., if control of the trigger pulse generation had been transferred to Interrupt 1, the program would proceed directly to step 175 to resume the main loop.

Interrupt 1

Figure 5:
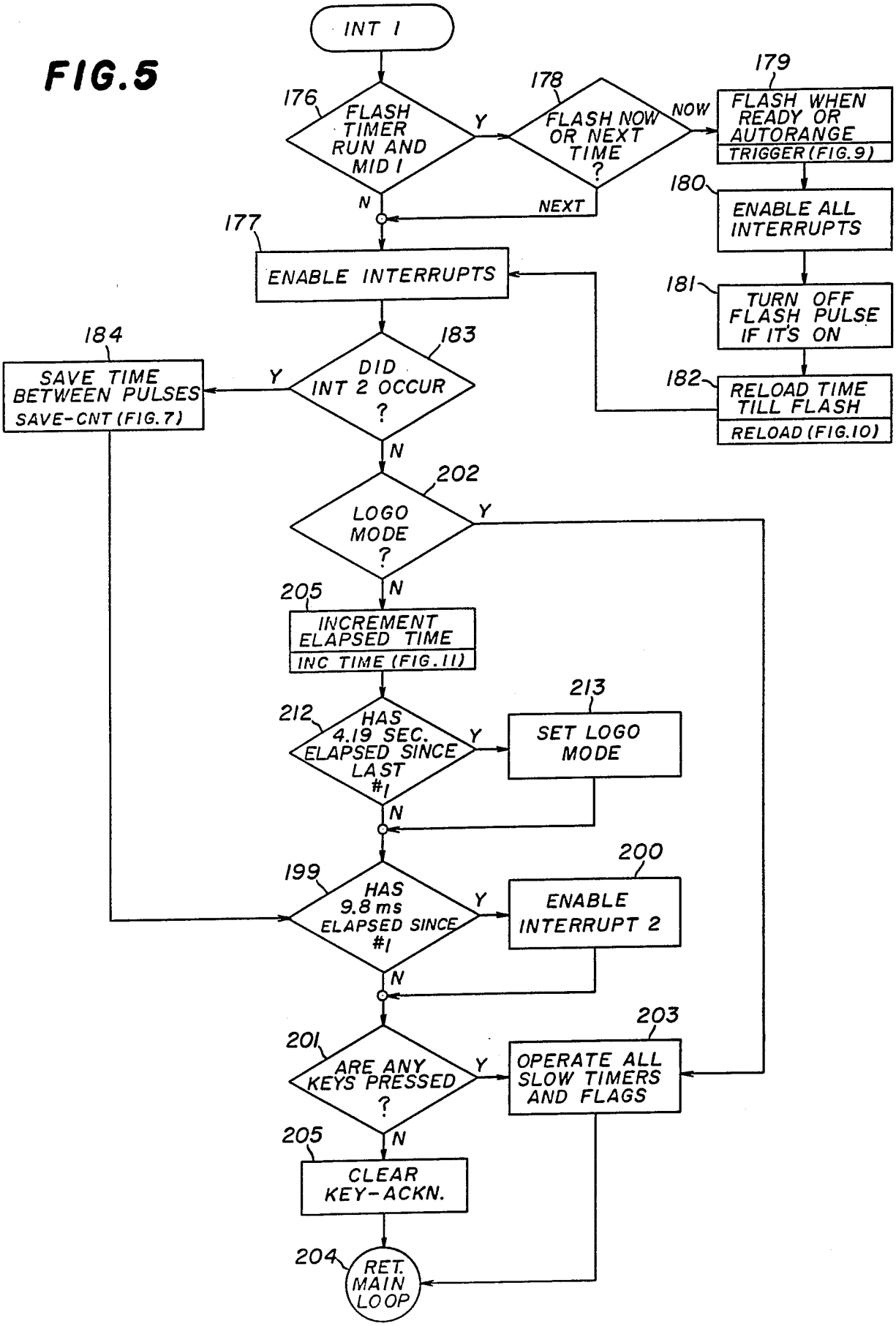

Referring now to FIG. 5, the Interrupt 1 routine will now be described. Upon initiation of Interrupt 1, the other Interrupts are disabled. First, the program moves to step 176 to ask if the flash timer run has been enabled and the Mid 1 range has been set. In other words, has control of generation of a flash trigger pulse been transferred to Interrupt 1 (see FIG. 6, steps 160–163)? If it has not, the program moves to step 177 to enable the Interrupts. If it has, it moves to step 178 to ask whether the flash trigger pulse is to be generated during this Interrupt 1 or in a subsequent one. If it is to be generated in the current Interrupt 1, i.e., in less than 256 counts of Timer 1, the program moves to step 179 to generate the flash trigger pulse by actuating the TRIGGER subroutine of FIG. 9. The program then enables all the Interrupts at step 180, turns off the flash pulse if it is on, at step 181, then reloads the TTFL value, using the RELOAD subroutine of FIG. 10, at step 182. The program then moves to step 177. If, at step 178, the flash was not to occur during the current Interrupt 1, then the program would move directly to step 177.

The Interrupt 1 routine then moves to step 183 to ask if Interrupt 2 has occurred. If so, the program moves to step 184 to save the time P between pickup pulses by using the SAVE-CNT subroutine of FIG. 7. This is necessary because this time period will be stored here and used later by the main loop (FIG. 4) to compute the TD value.

SAVE-CNT Subroutine

Figure 7:
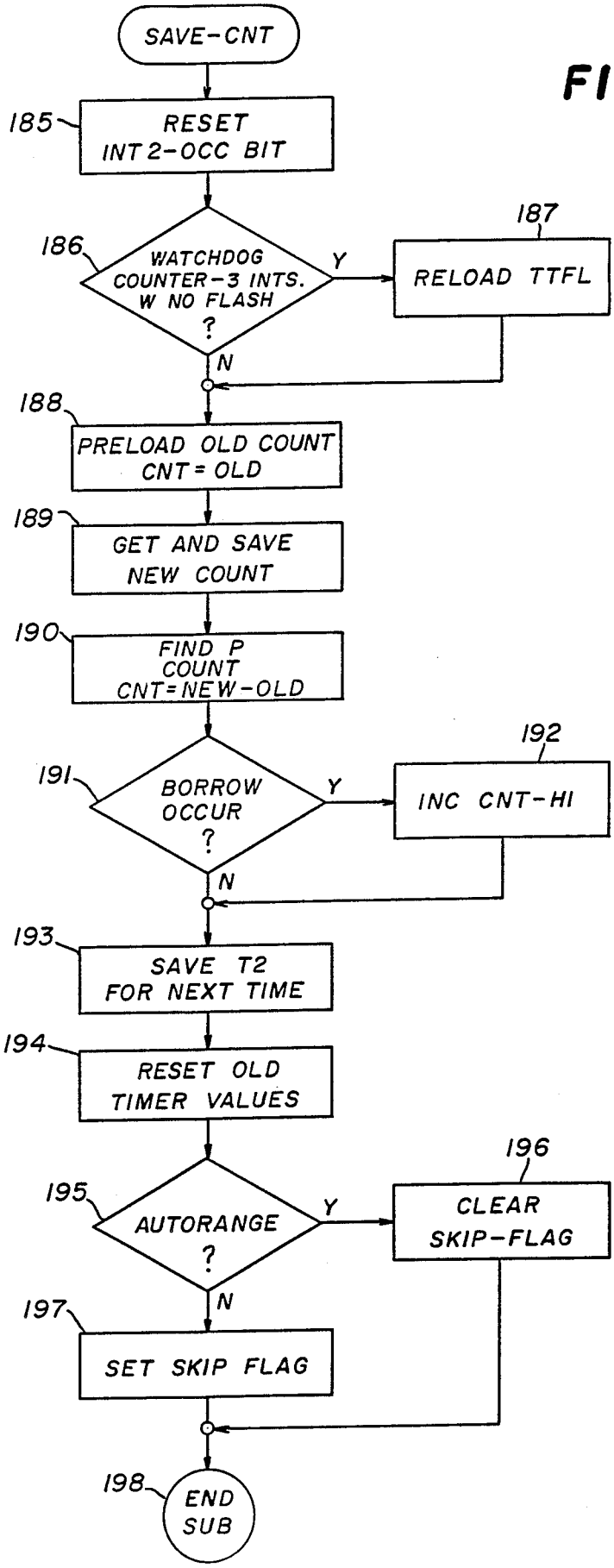

Referring to FIG. 7, the SAVE-CNT subroutine first moves to step 185 to reset the flag indicating that Interrupt 2 has occurred. Then, at step 186, the subroutine checks the Watchdog Counter to see if three consecutive Interrupt 2's have occurred without a flash. This condition might occur in the event of noise which could cause the program to go into a long time delay loop of several seconds, despite the fact that the engine is still running. If this condition has occurred, the program moves to step 187 to reload the TTFL time period and then to step 188. Otherwise it moves directly to step 188.

Next, the subroutine proceeds to compute the count corresponding to the period P between the last two pickup pulses (P1 and P2). As can be seen from waveform G of FIG. 13, this count will comprise a whole number of Timer 2 counts (5 in this case) plus beginning and end offset periods which are less than a Timer 2 period. First, at step 188, the program loads the count which the timer had achieved at the pickup pulse (P1) immediately preceding the last one. It will be appreciated that this count will comprise a number n of Timer 2 counts, plus a number of Timer 1 counts corresponding to the end offset between the nth Timer 2 count and the P1 pickup pulse. Next, the program, at step 189, gets and saves the timer count at the last pickup pulse P2, which will also comprise a combination of Timer 2 and Timer 1 counts. In the example of waveform G, five Timer 2 counts have occurred between the P1 and P2 pulses, so the new Timer 2 count will be n+5. Then, in step 190, the program subtracts the old count at pickup pulse P1 from the new count at pickup pulse P2 to find the difference, which corresponds to period P.

At step 191, the subroutine asks if a borrow has occurred as a result of the subtraction. If it has, it increments the high byte of the counter at step 192 and then proceeds to step 193, to which it would have proceeded directly if no borrow had occurred. At step 193 the subroutine saves the count in Timer 2 and then, at step 194, resets the old timer values. At step 195, the subroutine asks if the system is in the "autorange mode". If it is, it clears the skip flag at step 196, and if it is not it sets the skip flag at step 197, and then ends the subroutine and step 198.

Returning to FIG. 5, the Interrupt 1 routine then moves to step 199 to ask if 9.8 ms has elapsed since the last pickup pulse, 9.8 ms being an arbitrary period which corresponds to a whole number of Timer 2 counts (6) and which is less than the smallest feasible P time period (12 ms at 9990 rpm). If 9.8 ms has elapsed, the program enables Interrupt 2 at step 200 and then moves to step 201 to ask if any keys have been pressed. If 9.8 ms has not elapsed, the program moves directly to step 201. Thus, the program blanks out the Interrupt 2 for 9.8 ms to eliminate the effect of any spurious noise pulses or the like during that interval.

If, at step 183, an Interrupt 2 had not occurred, the program would drop to step 202 to ask if the system is in the Logo mode. If it is, it moves directly to step 203 to operate all the slow timers and flags and then returns to the main loop at step 204. If the system is not in the Logo mode, the program moves to step 205 to increment the elapsed time counter using the INC-TIME subroutine of FIG. 11.

INC-TIME Subroutine

In the INC-TIME subroutine, the program first increments the main timer at step 206 and then asks, at step 207, if the flash timer is running. If it is not, the subroutine ends immediately at step 208. If the flash timer is running, the program decrements it at step 209 and then checks at step 210 to see if it has timed down to less than two counts of the Timer 2 counter. If it has not, the subroutine ends, and if it has the program moves to step 211 to set the Mid 1 range of the TTFL delay time and set the flag to generate the flash trigger on the next Interrupt 1, and then ends the subroutine at step 208.

Returning to FIG. 5, the program next asks if 4.19 seconds has elapsed since the last pickup pulse. This time period corresponds to the slowest speed at which the engine can be expected to operate. If this time has elapsed, it can be assumed that the engine is no longer running, so the program sets the Logo mode at step 213 and moves to step 199. If 4.19 seconds has not elapsed, the program moves directly to step 199 and then to step 201 to check to see if any keys have been pressed since the last Interrupt 1. If they have, the program moves to step 203 to operate the slow timers and then returns to the main loop. If no keys have been pressed, the program moves to step 205 to clear the key acknowledge flag and then returns to the main loop.

From the foregoing, it can be seen that the program 90 operates in a continuously recycling main loop which, during each circuit recalculates the time period P between the last two pickup pulses, which is a measure of engine speed. The main loop also recalculates the time delay after a pickup pulse until the flash is triggered (TTFL) in accordance with the advance angle A° which has been dialed in by the user, all in accordance with the latest available data. Thus, the system repeatedly computes the time delay until flash, automatically accounting for changes in engine speed. Furthermore, the system automatically compensates for inherent system delays to provide an extremely accurate computation of the advance (or retard) time delay. The system provides for a full range of advance angles from −180° to +180°, and requires only a single connection to the engine, thereby making the system extremely convenient and readily adaptable to use with either gasoline or diesel engines. The system operates under microprocessor control so as to provide a compact and easily portable hand-held unit, which provides accurate timing even at very high engine speeds.

I claim:

1. Digital engine timing apparatus for use in testing a multi-cylinder internal combustion piston engine having a control system for sequentially providing fuel ignition in the engine cylinders in a predetermined order, said timing apparatus comprising: timing light means for providing a light pulse in response to an electrical trigger pulse; pickup means responsive to each ignition in a selected cylinder for generating a pickup signal; operator-actuated means for selectively producing a variable angular value representative of an angular relationship between ignition in the selected cylinder and a predetermined position of the associated piston; and processor means operating under stored program control and coupled to said timing light means and to said pickup means and to said operator-actuated means, said processor means including timing means for generating digital data corresponding to the time period between consecutive pickup signals, means for computing from only said angular value and said digital data a time delay value corresponding to said angular value, and means for producing said trigger pulse at a time spaced from said pickup signal by a predetermined function of said time delay value.

2. The timing apparatus of claim 1, and further comprising display means responsive to said operator-actuated means for displaying said variable angular value.

3. The timing apparatus of claim 1, and further comprising tachometer means for computing from said digital data the speed of the engine in revolutions per minute.

4. The timing apparatus of claim 3, and further comprising display means, and mode selection means coupled to said display means and selectively operable to either a first mode wherein said display means is responsive to said operator-actuated means for displaying said variable angular value or a second mode responsive to said tachometer means for displaying the engine speed in revolutions per minute.

5. The timing apparatus of claim 1, wherein said pickup means includes inductive pickup means to adapt said timing apparatus for use with a gasoline engine.

6. The timing apparatus of claim 1, wherein said pickup means includes luminosity pickup means to adapt said timing apparatus for use with a diesel engine.

7. The timing apparatus of claim 1, wherein said operator-actuated means includes means permitting production of a variable angular value in the range from +180° to −180°.

8. Digital engine timing apparatus for use in testing a multi-cylinder internal combustion piston engine having a control system for sequentially providing fuel ignition in the engine cylinders in a predetermined order, said timing apparatus comprising: timing light means for providing a light pulse in response to an electrical trigger pulse; pickup means responsive to each ignition in a selected cylinder for generating a pickup signal; operator-actuated means for selectively producing a variable angular value representative of an angular relationship between ignition in the selected cylinder and a predetermined position of the associated piston; and processor means operating under stored program control and coupled to said timing light means and to said pickup means and to said operator-actuated means, said processor means including timing means for generating digital data corresponding to the time period between consecutive pickup signals, means for computing from only said angular value and said digital data a time delay value corresponding to said angular value, means for causing said trigger pulse to be produced at a time following said pickup signal by said time delay value if said variable angular value is not less than zero, and means for causing said trigger pulse to be produced at a time following said pickup signal by said time period between consecutive pickup signals less said time delay value if said variable angular value is less than zero.

9. The timing apparatus of claim 8, wherein said operator-actuated means includes means permitting production of a variable angular value in the range from +180° to −180°.

10. The timing apparatus of claim 8, and further comprising tachometer means for computing from said digital data the speed of the engine in revolutions per minute.

11. The timing apparatus of claim 8, wherein said processor means includes means responsive to said timing means for causing said trigger pulse to be produced in response to each pickup signal if the engine speed is less than a first predetermined value and causing said trigger pulse to be produced in response to every other pickup signal if said engine speed is greater than a second predetermined value.

12. The timing apparatus of claim 8, wherein said means for computing repeatedly recomputes said time delay value at least once during the period between each two consecutive pickup signals.

13. Digital engine timing apparatus for use in testing a multi-cylinder internal combustion piston engine having a control system for sequentially providing fuel ignition in the engine cylinders in a predetermined order, said timing apparatus comprising: timing light means for providing a light pulse in response to an electrical trigger pulse; pickup means responsive to each ignition in a selected cylinder for generating a pickup signal; operator-actuated means for selectively producing a variable angular value representative of an angular relationship between ignition in the selected cylinder and a predetermined position of the associated piston; and processor means operating under stored program control and coupled to said timing light means and to said pickup means and to said operator-actuated means, said processor means including timing means for generating digital data corresponding to the time period between consecutive pickup signals, means for computing from only said angular value and said digital data a nominal time delay value corresponding to said angular value, said means for computing including means for subtracting from said nominal time delay value an error value corresponding to the time required for said apparatus to respond to said pickup signal to generate a corrected time delay value, and means for producing said trigger pulse at a time spaced from the time said apparatus responds to said pickup signal by a predetermined function of said corrected time delay value.

14. The timing apparatus of claim 13, wherein said means for producing said trigger pulse includes means for causing said trigger pulse to occur at a time following said pickup signal by said corrected time delay value if said variable angular value is not less than zero, and means for causing said trigger pulse to occur at a time following said pickup signal by said time period between consecutive pickup signals less said corrected time delay value if said variable angular value is less than zero.

15. The timing apparatus of claim 13, and further comprising tachometer means for computing from said digital data the speed of the engine in revolutions per minute.

16. The timing apparatus of claim 15, and further comprising display means, and mode selection means coupled to said display means and selectively operable to either a first mode wherein said display means is responsive to said operator-actuated means for displaying said variable angular value or a second mode responsive to said tachometer means for displaying the engine speed in revolutions per minute.

17. The timing apparatus of claim 13, wherein said processor means includes means responsive to said timing means for causing said trigger pulse to be produced in response to each pickup signal if the engine speed is less than a first predetermined value and causing said trigger pulse to be produced in response to every other pickup signal if said engine speed is greater than a second predetermined value.

18. The timing apparatus of claim 13, wherein said error value is constant.

* * * * *